US005156407A

United States Patent [19]

Moore

[11] Patent Number: 5,156,407

[45] Date of Patent: Oct. 20, 1992

[54] QUESTION AND ANSWER BOARD GAME

[76] Inventor: Christopher L. Moore, Attack Squadron 115, FPO AP, San Francisco, Calif. 96601-6228

[21] Appl. No.: 836,828

[22] Filed: Feb. 19, 1992

[51] Int. Cl.[5] ..... A63F 3/00; A63F 9/18

[52] U.S. Cl. ..... 273/249; 273/431

[58] Field of Search ..... 273/293, 249, 250–254, 273/256, 430–432

[56] References Cited

U.S. PATENT DOCUMENTS 4,714,255 12/1987 Henry et al. ..... 273/249

4,889,345 12/1989 Wawryk ..... 273/249

4,934,709 6/1990 Peterson ..... 273/249

OTHER PUBLICATIONS

What's The Word by the Karian Corporation, 1984.

*Primary Examiner*—Benjamin H. Layno

*Attorney, Agent, or Firm*—H. Jay Spiegel

[57] ABSTRACT

A board game is disclosed in which the players travel from a start location to a pot labeled success along one of four chosen paths. Each path represents a unique degree of difficulty and a unique number of spaces. The path with the greatest degree of difficulty has the least number of spaces and players traveling along paths of greater difficulty must answer more difficult questions to advance their path. Some spaces in each path have a symbol indicating that a special action card must be chosen with instructions set forth on the action card being followed. The first player to arrive at the success pot is declared the winner.

9 Claims, 2 Drawing Sheets

QUESTION AND ANSWER BOARD GAME

BACKGROUND OF THE INVENTION

The present invention relates to the Dreams and Rainbows Board Game. In the prior art, various board games are known wherein the various players follow a path to a goal or finishing location. However, Applicant is unaware of any such game including all of the features and aspects of the present invention.

The following prior art is known to Applicant:

U.S. Pat. No. 4,136,879 to Andrew et al. discloses an intern board game which portrays the trials, tribulations and triumphs of an intern and is played on a board simulating a large teaching hospital. The present invention differs from the teachings of Andrew et al. as contemplating a game board wherein a plurality of paths of differing difficulties are provided and the players must choose their desired level of difficulty and answer questions corresponding to the chosen level of difficulty.

U.S. Pat. No. 4,368,889 to Reker, Jr. discloses a game experience for simulating school experience which includes a game board having an outer path and a plurality of inner paths with players traversing the first path and entering the internal paths and successfully exiting them with the first player to complete a plurality of school paths being declared the winner. The present invention differs from the teachings of Reker, Jr. as contemplating a board game wherein players choose professions and choose a level of difficulty and each player travels along the chosen path to a success pot.

U.S. Pat. No. 4,372,559 to Summers discloses an educational game for student and/or graduate nurses wherein a board is provided having a plurality of contiguous areas extending around the perimeter of the board with additional areas being provided centrally. In playing the game, players answer questions traveling through an acute group, an intermediate group and a convalescence group. The present invention differs from the teachings of Summers as contemplating a game wherein the players choose one of a plurality of paths of differing difficulty, choose a particular profession and answer questions about that profession at the desired degree of difficulty to traverse the desired path to a success pot.

SUMMARY OF THE INVENTION

The present invention relates to the Dreams and Rainbows Board Game. The present invention includes the following interrelated objects, aspects and features:

(A) In a first aspect, the inventive game includes a board having a design resembling a rainbow extending in an arcuate path from a start position to a success pot.

(B) The rainbow has a plurality of different colors with each color defining a particular path. The paths have differing numbers of spaces, for example, including a gold path having nine spaces, a blue path having eleven spaces, a red path having fourteen spaces and a green path having twenty spaces. Thus, a player traversing the gold path need only traverse nine spaces between the start location and the success pot, whereas, for example, a player traversing the green path must traverse twenty spaces from the start location to the success pot.

(C) Each unique path has its own unique degree of difficulty with the path having fewer spaces having a greater degree of difficulty. In playing the game, players answer questions concerning a particular desired career which has been chosen. Each player picks a chosen career and a chosen level of difficulty and takes the appropriate path whether green, red, blue or gold depending upon the degree of difficulty. Thus, for example, a player choosing the career of accountant and choosing the gold path will have to answer questions about being an accountant which are of the greatest difficulty thus resulting in the likelihood that it will be more difficult to correctly answer the questions and thereby move from space to space along the path from the start line to the success pot. Conversely, another player choosing the accountant career and the green path will have to traverse twenty spaces rather than the nine spaces in the gold path, however, the questions will be much easier to answer and thus it will be more likely that the player will more quickly move from space to space along the green path.

(D) Each path has a plurality of spaces having markings thereon indicating that the player should choose an "action card". Such action cards, when chosen, give the player instructions which must be followed such as, for example, "move back one space", "move ahead one space", "lose one turn", "gain an extra turn", "move to adjacent path" or "go back to start". These are merely examples of the wording and printing which may be placed on these action cards.

(E) After the players have chosen their desired career and their desired path, play begins in an order of play agreed upon between the players. If desired, a chance device such as dice may be used to determine the order of play. The game is provided with a multiplicity of question and answer cards for each chosen profession with each card having four questions, one corresponding to each of the four paths. A player is asked the appropriate question based upon the level of difficulty chosen and the corresponding path chosen and players advance one space along their path for each correct answer to a question. If desired, the game may have a rule that two consecutive wrong answers cause a player to move back one space.

(F) If desired, a player may choose to switch to another path of differing difficulty and in so doing loses that turn.

As such, it is a first object of the present invention to provide the Dreams and Rainbows Board Game.

It is a further object of the present invention to provide such a game wherein a plurality of paths are printed on a board and players may choose the path which they will traverse.

It is a still further object of the present invention to provide such a game wherein each player chooses a desired profession and answers questions about that profession.

It is a yet further object of the present invention to provide such a game wherein question and answer cards are provided for each profession with differing degrees of difficulty being represented by differing questions on each card.

It is a still further object of the present invention to provide such a game wherein action cards are provided to give instructions to players landing on spaces where it is required to choose an action card.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
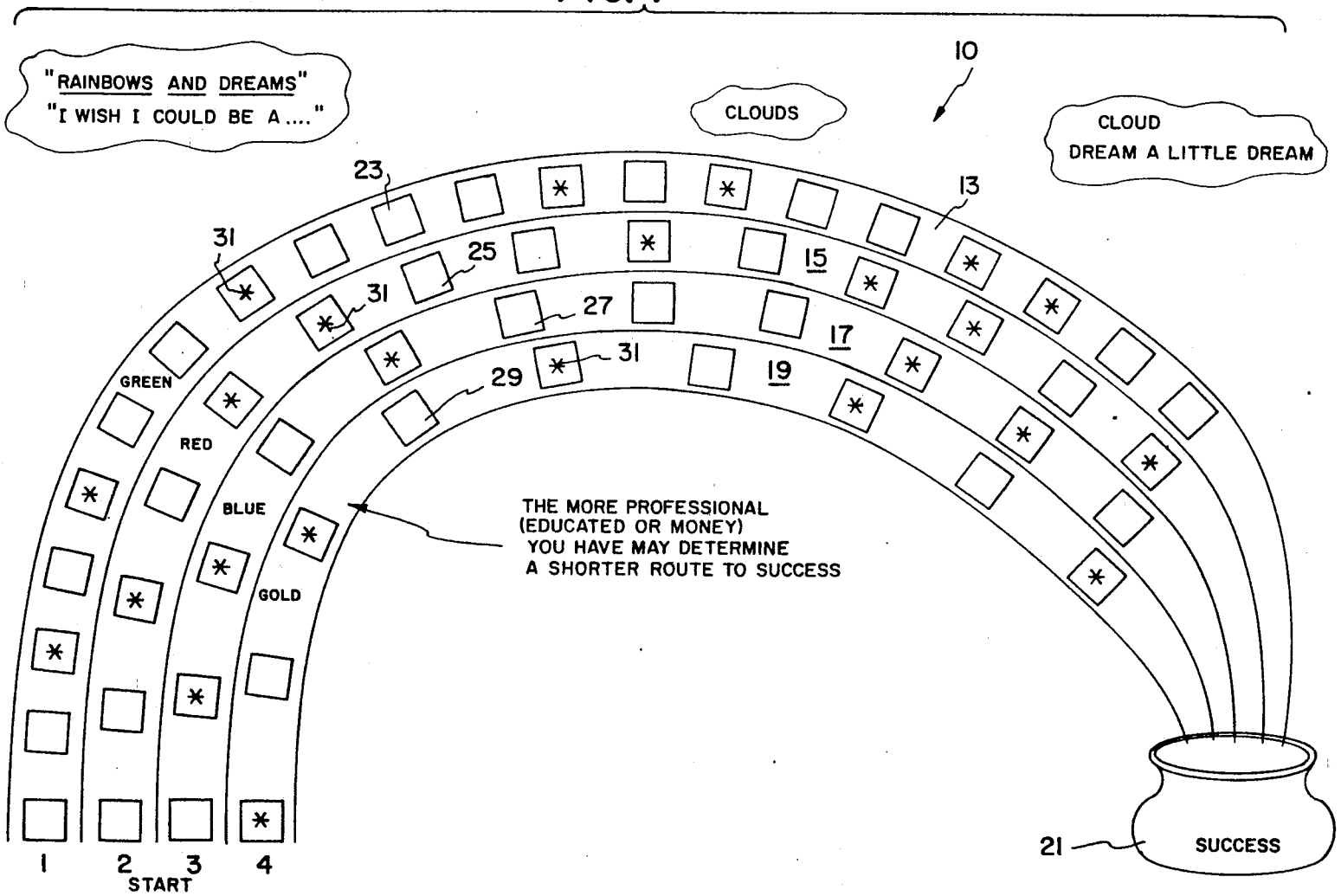
FIG. 1 shows a schematic representation of the inventive board.

With reference, first, to FIG. 1, a schematic representation of the board of the present invention is generally designated by the reference numeral 10 and is seen to include paths 13, 15, 17 and 19 which emanate from a start area 11 and extend in a parallel fashion to a success pot 21.

The path 13 is deemed the "green" path and includes twenty spaces 23 from the start area 11 to the pot 21. The path 15 is designated the "red" path and has fourteen spaces 25 between the start area 11 and the success pot 21. The path 17 is designated the "blue" path and has eleven spaces 27 from the start area 11 to the success pot 21. Finally, the path 19 is designated the "gold" path and includes nine spaces 29 from the start area 11 to the success pot 21.

Some of the spaces 23, 25, 27, 29 have a marking 31 thereon for a purpose to be described in greater detail hereinafter.

Figure 2:
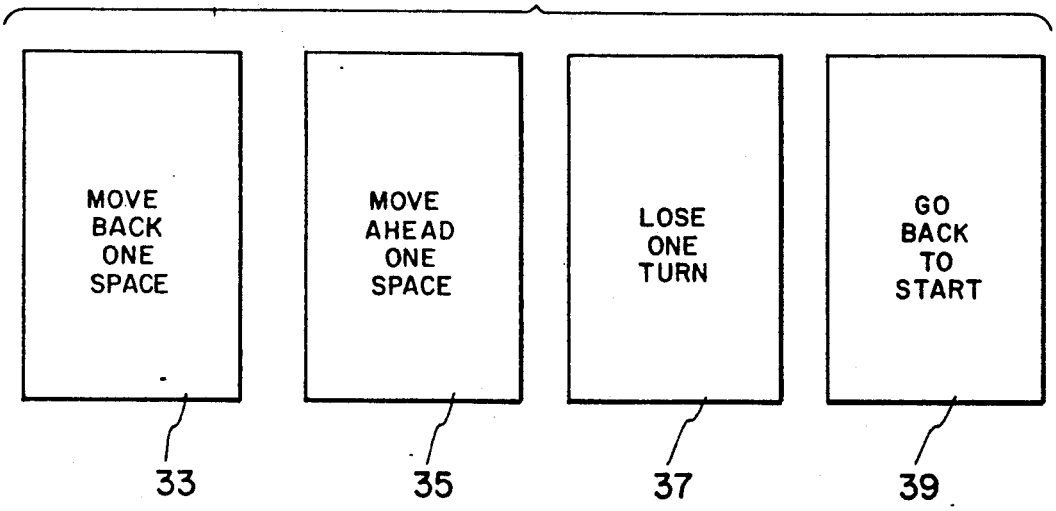
FIG. 2 shows examples of action cards.

With reference to FIG. 2, a plurality of action cards 33, 35, 37 and 39 are illustrated. These cards illustrate four examples of printing which may be placed on the action cards. Over and above the instructions printed on these cards, other instructions may include "gain an extra turn", "move to an adjacent path" or other instructions.

Figure 3:
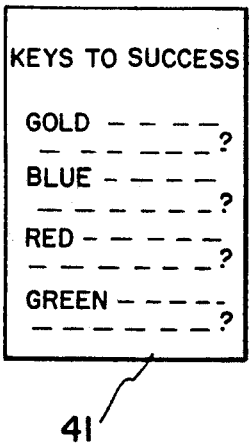
FIG. 3 shows an example of a question and answer card.

FIG. 3 shows an example of a question and answer card 41 having the words "keys to success" printed on the top thereof. Also shown in FIG. 3 are the words "gold", "blue", "red" and "green" with each of these words having, adjacent thereto, a particular question. Each card 41 pertains to only a single chosen career or profession with cards 41 being provided for numerous professions and careers allowing players to choose a particular career for the category of questions which are to be answered. Examples of career categories which may be used in accordance with the teachings of the present invention and for which a series of cards 41 may be provided include accountant, architect, astronaut, comedian, doctor, dentist, fireman, paramedic, engineer, lawyer, military officer, policeman, detective, politician, pop star, salesman, scientist, sports hero, teacher.

Questions may be asked in any one of a number of categories pertaining to the profession or career category which has been chosen. As should be understood by those skilled in the art, and as explained above, the degree of difficulty of the questions which are asked of a particular player will depend upon the particular level of difficulty chosen and the corresponding path 13, 15, 17 or 19 which has been chosen. For purposes of example, the green path 13 is termed the beginner path, the red path 15 has been deemed the intermediate path, the blue path 17 has been deemed the novice path and the gold path 19 has been deemed the professional path.

With the above description having been made, the manner of play of the inventive game will now be described. Through the use of a chance device such as dice, the players determine the order of play of the game as well as the order in which players may choose their career path and degree of difficulty. Only one player may play the game designating a particular career path and particular degree of difficulty.

After the players have chosen their particular career path and degree of difficulty, players place a token (not shown) at the start area at the beginning of the path which they have chosen. The particular design of the tokens is not an important aspect of the inventive game. In the order of play previously determined, players pick question and answer cards 41 corresponding to their profession and a designated opponent asks the player the particular question corresponding to the green, red, blue or gold path which has been chosen. The card 41 has the answer to each question printed thereon as well. If the player correctly answers the question, the player may advance one space along their chosen path. If the player incorrectly answers the question, they may not move ahead. Furthermore, if a player is on a space other than the start area 11 and incorrectly answers two consecutive questions, that player must move backward one space.

As players answer questions and advance along their path, occasionally, a player will land on a space having a marking 31 thereon. Under such circumstances, that player must draw one of the action cards depicted in FIG. 2 or as disclosed hereinabove and must follow the instructions set forth on the chosen card. If a player so desires, instead of choosing a question and answer card 41, that player may, alternatively, move to a space on an adjacent path so long as that space is physically located further from the success pot 21 than the space where they are located on their originally chosen path.

Players play the game in this manner and the first player to answer a question correctly causing them to arrive at the success pot 21 is declared the winner.

As such, an invention has been disclosed in terms of a preferred embodiment thereof which fulfills each and every one of the objects of the invention as set forth hereinabove and provides a new and useful Dreams and Rainbows Board Game of great novelty and utility.

Of course, various changes, modifications and alterations in the teachings of the present invention may be contemplated by those skilled in the art without departing from the intended spirit and scope thereof. As such, it is intended that the present invention only be limited by the terms of the appended claims.

I claim:

1. An improved board game, comprising:

a) a board having a design thereon resembling a rainbow including a start area, a multiplicity of parallel arcuate paths extending from said start area and extending to a finish area including a design resembling a pot;

b) each of said paths being of a unique color;

c) each of said paths having a plurality of spaces thereon, including at least a first path having a first number of spaces thereon, a second path having a second greater number of spaces thereon and a third path having a still greater number of spaces thereon;

d) a plurality of question-answer cards for each of a plurality of diverse professions, each of said cards having a number of questions and corresponding answers pertaining to a particular profession printed thereon, said number corresponding to a number of paths on said board, said questions on each card marked with a unique color and said questions on each card respectively having differing degrees of difficulty including at least a first question having a color corresponding to the color of said first path and having a greatest degree of difficulty, a second question having a color corresponding to the color of said second path and having a lesser degree of difficulty and a third question having a color corresponding to the color of said third path and having a still lesser degree of difficulty;

e) a player on said first path answering said first question, a player on said second path answering said second question and a player on said third path answering said third question;

f) each player, in playing said game, choosing a profession and a path; and g) players answer questions pertaining to a chosen profession and with a degree of difficulty corresponding to the path chosen, with the first player arriving at said finish area being declared the winner.

2. The invention of claim 1, wherein some of said spaces have an indication thereon which spaces, when landed upon by a player, require said player to pick an action card.

3. The invention of claim 2, wherein each action card has instructions thereon which must be followed.

4. The invention of claim 3, wherein said instructions cause a player to move back one space.

5. The invention of claim 3, wherein said instructions cause a player to move ahead one space.

6. The invention of claim 3, wherein said instructions cause a player to lose one turn.

7. The invention of claim 3, wherein said instructions cause a player to gain one turn.

8. The invention of claim 1, wherein said profession is chosen from the group consisting of accountant, architect, astronaut, comedian, doctor, engineer, lawyer, policeman, politician, salesman, scientist and teacher.

9. The invention of claim 1, wherein a chance device is included to determine order of play.

* * * * *